US007654471B2

(12) United States Patent
Johnson

(10) Patent No.: US 7,654,471 B2
(45) Date of Patent: Feb. 2, 2010

(54) WATERFALL APPARATUS

(76) Inventor: Bruce Johnson, 1342 S. Powerline Rd., Deerfield Beach, FL (US) 33442

( * ) Notice: Subject to any disclaimer, the term of this patent is extended or adjusted under 35 U.S.C. 154(b) by 0 days.

(21) Appl. No.: 12/010,327

(22) Filed: Jan. 23, 2008

(65) Prior Publication Data

US 2009/0184174 A1 Jul. 23, 2009

(51) Int. Cl.

| | |
|---|---|
| ***B05B 1/36*** | (2006.01) |
| ***B05B 1/26*** | (2006.01) |
| ***B05B 17/08*** | (2006.01) |
| ***B05B 1/14*** | (2006.01) |
| ***E04H 4/14*** | (2006.01) |
| ***E03C 1/04*** | (2006.01) |

(52) U.S. Cl. ..... 239/193; 239/12; 239/17; 239/504; 239/590.5; 4/507; 4/678

(58) Field of Classification Search ..... 239/12, 239/17, 21, 193, 211, 462, 504, 542, 589, 239/590, 590.3, 590.5, 597, DIG. 17; 4/507, 4/567, 569, 615, 675, 678

See application file for complete search history.

(56) References Cited

U.S. PATENT DOCUMENTS

| | | | | |
|---|---|---|---|---|
| 3,599,877 | A | 8/1971 | Goldschmied | |
| 4,355,762 | A | 10/1982 | Coleman | |
| 4,396,508 | A | 8/1983 | Broughton | |
| 4,881,280 | A | 11/1989 | Lesikar | |
| 4,912,782 | A | 4/1990 | Robbins | |
| 5,115,974 | A | 5/1992 | Tobias et al. | |
| 5,388,285 | A | 2/1995 | Belniak | |
| 5,524,822 | A | 6/1996 | Simmons | |
| 5,537,696 | A * | 7/1996 | Chartier | 4/507 |
| 5,738,280 | A | 4/1998 | Ruthenberg | |
| 5,893,179 | A * | 4/1999 | Johnson | 4/507 |
| 6,170,094 | B1 | 1/2001 | Weise et al. | |
| 6,367,100 | B2 | 4/2002 | Koren et al. | |
| 6,450,418 | B1 | 9/2002 | Simpson et al. | |
| 6,481,027 | B1 | 11/2002 | Biancamano | |

(Continued)

FOREIGN PATENT DOCUMENTS

| | | |
|---|---|---|
| JP | 2000296161 | 10/2000 |

(Continued)

*Primary Examiner*—Darren W Gorman
(74) *Attorney, Agent, or Firm*—Eric J. Weierstall, Esq.; Tangent Law Group

(57) ABSTRACT

The invention is directed to, in one embodiment, a waterfall apparatus having an at least one water supply inflow supplying water to the waterfall apparatus and a body member having the water flowing therethrough. A water accumulation portion of the body member can be coupled to and filled by a water supply inflow. An at least one baffle having an at least one tube member interspaced thereon and extends from the accumulation portion of the body member to an outlet portion of the body member. An outlet flow path is in communication with the outlet portion of the body member, passing the water from the outlet portion of the body member along the outlet flow path and through a waterfall outlet, forming a sheet like waterfall outflow. The at least one interspaced tube member, angled entry portion and optional deflection member work to deflect, slow and smooth the flow, reduce debris accumulation and generally improve the sheet like quality and consistency of the flow of the sheet-like waterfall.

15 Claims, 6 Drawing Sheets

U.S. PATENT DOCUMENTS

| | | | | |
|---|---|---|---|---|
| 6,578,774 | B1 | 6/2003 | Noyes | |
| 6,945,468 | B1 | 9/2005 | Rodriguez et al. | |
| 2003/0010836 | A1 * | 1/2003 | Pham | 239/17 |
| 2005/0155144 | A1 * | 7/2005 | McDonald et al. | 4/507 |
| 2006/0117476 | A1 | 6/2006 | Kunkel | |

FOREIGN PATENT DOCUMENTS

| | | |
|---|---|---|
| JP | 2002153991 | 5/2002 |
| JP | 2004000845 | 1/2004 |

* cited by examiner

WATERFALL APPARATUS

BACKGROUND OF THE INVENTION

1. Field of the Invention

The invention relates to water arrangements in pools, ponds, spas or water features and, more particularly, to the field of decorative waterfalls or fountains for water pools, ponds, spas, and water features.

2. Background

Waterfalls have been in existence for centuries in countless different variations and forms. The enduring popularity of both waterfalls and fountains can be attributed to their numerous aesthetic and practical applications, making them desirable for artistic, recreational and commercial uses. For aesthetic appearance, man made waterfalls or waterfall arrangements are often used in a swimming pools, ponds, spas, water features or the like. The water is often drawn from the pool or water feature and passes over the edge of a wall or a weir. Various configurations of these waterfalls have been developed, over the years.

Some of the waterfalls include pumping or drawing water into a lower portion of a body of the pool or basin structure and allowing the water to fall from an upper portion thereof as the water fills or continues to fill the body. Waterfall devices for swimming pools typically include a water accumulation box and an outlet port from which escapes the desired waterfall.

One aesthetically pleasing version uses a smooth, sheet-like waterfall. Some or all of the water from a water circulation pump is typically diverted from a body of water into the waterfall device where it is accumulated typically in a water accumulation box. Baffle members are usually employed to smooth out turbulence so that the water exiting the outlet port is in the form of a relatively smooth sheet.

The water falls or descends over an edge of a wall or opening to another pool of water or conduit positioned at a lower elevation. Some examples of such waterfalls can be seen in U.S. Pat. No. 5,309,581 by Lockwood et al. titled "Water Steam Apparatus," U.S. Pat. No. 5,388,285 by Belniak titled "Swimming Pool Waterfall," and U.S. Pat. No. 5,537,696 by Chartier titled "Apparatus For Producing Sheet Waterfall For Pool Or Spa."

Another example is seen in U.S. Pat. No. 5,738,289 to Ruthenburg. Ruthenburg is typical of existing devices, using multiple baffle members with simple holes permitting the flow to pour through each member and redirecting the flow, in an attempt to even out the flow. This results in a restriction on the length of the flow due to the lack of any real reduction in velocity from the baffle members. Moreover, the multiple baffles with simple holes do not help screen debris sufficiently or adequately compensate for clogged baffles or baffle portions. Additionally, the added baffle members add to the cost and complexity in manufacturing these devices.

Some water features have featured a channel or tube structure to communicate water within the device, such as U.S. Pat. No. 6,170,094 to Weise. However, these devices typically jet or increase pressure and thereby substantially increase velocity within these structures. These jetting tubes are also not placed properly relative to the flow of the water or within the device to effectively provide the desired velocity profile manipulation that the instant invention imparts through its multiple tubes, the location of the baffle, the diffuser, and the angled entry portion.

Problems with controlling the water flow into, through, and from the body of the pool or spa have required continued improvement in the area of waterfalls, including different types or styles of structures and flows to control the output for the waterfall. In particular, a laminar or sheet flow remains particularly desirable, however as the scale of a waterfall apparatus increases it is increasingly difficult to maintain this sheet like flow. Additionally, pump surges and debris blockage can disrupt the smoothed, sheet-like flow.

In addressing the sheet water fall appearance or laminar flows in general, there exists a need for an improved waterfall apparatus that improves the sheet characteristics of water flowing out of the waterfall device and provides for improved screening of particulate from the sheet-like waterfall apparatus.

Reduction in velocity and a uniformity of water distribution, both in terms of the water pressure, velocity, and direction of flow, must be accomplished if the waterfall is to have the pleasingly uniform sheet-like appearance that is desired. When a waterfall of several feet in length is required, the problem of distribution of water within the waterfall apparatus becomes particularly challenging with the heretofore known multiple baffle member systems.

Another problem with conventional waterfall apparatus of the type mentioned above is that debris, which may be introduced into the waterfall or any where along the water flow, can obstruct the device and result in the disruption of the water flow. Existing designs fail to provide sufficient debris screening, redundancy, and balance if debris occlusion does occur. A need exists for a waterfall apparatus that addresses these shortcomings.

SUMMARY OF THE INVENTION

In view of the above, it would be desirable and is an object of the invention to provide a waterfall apparatus and method which avoids one or more of the deficiencies of the related art.

The longstanding but heretofore unfulfilled need for a versatile waterfall device that include scalability, enhanced control of the flow to form a sheet, and enhanced debris screening are met by the instant invention.

A further object of the invention includes a waterfall apparatus and associated method for more efficiently controlling water flow within and from a waterfall arrangement by reducing the velocity of an incoming water flow to provide a smoothed waterfall output.

Yet another object of the invention is to provide a waterfall apparatus and associated methods which enhance the aesthetic appearance of waterfall arrangements, provide enhanced debris screening and allow for balanced water distribution to overcome any debris obstructions.

Additionally the instant invention advantageously provides a design and construction of a waterfall apparatus which can be mass produced less expensively and more easily handled and installed.

The present invention further provides a waterfall apparatus providing a sheer, sheet like waterfall that is easily scalable from small to large sized waterfalls without the need for extension of the overall length of the sheet-like waterfall apparatus.

More particularly, the apparatus of the invention includes a waterfall apparatus having an at least one water supply inflow supplying water to the waterfall apparatus, a body member having the water flowing therethrough, a water accumulation portion of the body member coupled to and being filled by a water supply inflow, an at least one baffle having an at least one tube member interspaced thereon and an outlet flow path forming a sheet like waterfall flow passing through a waterfall outlet.

The waterfall apparatus can also include an at least one deflector member with an at least one outlet slot, the at least one outlet slot slowing and directing the water from the tube in a smoothed, low pressure state. Additionally, the at least one deflector member with an at least one outlet slot can further include an at least one outlet extension that redirects water out of the at least one tube member at about a 90 degree angle relative to the end of the at least one tube member. The at least one outlet slot can comprise four slots spread equidistantly around the at least one tube member. The deflector member may also include a mesh material with a grid or other structure having defined outlets across the surface to diffuse the water traveling through the at least one tube member.

The at least one tube member extends from the at least one baffle member at a 90 degree angle. The waterfall apparatus can include an entry portion of the at least one tube member and a bottom portion of the water accumulation portion. The entry portion of the at least one tube member is angled to further reduce the velocity of the water within the at least one tube member. The distance between the bottom portion of the water accumulation portion and the angled entry portion can be a ratio of the width of the at least one tube member and the waterfall outlet. The distance between the bottom portion of the water accumulation box and the angled entry portion can for example be less than the size of a waterfall outlet. The distance between the bottom portion of the water accumulation box and the angled entry portion is equal to or less than ⅛ inch. The at least one tube member can be at least one of a round, oval, square, and elliptical shape.

The waterfall apparatus can also be provided with an entry portion of the at least one tube member that is angled to further reduce the velocity of the water through redirection into the at least one tube member and having the at least one tube member is elongate such that it penetrates the baffle member at ninety-degrees to the baffle member and an at least one diffusing member is provided at a point on the at least one tube member and the combination of the angled entry portion, the elongate at least one tube member, and the diffusing member reduce the velocity of the water flowing through the device to provide a smoothed, sheet-like waterfall at the waterfall outlet.

The method of the invention includes a method of slowing a flow of water within a waterfall apparatus, including the steps of providing a water inflow into an accumulation body portion of the waterfall apparatus, slowing the inflow by directing it into an at least one baffle member, passing the water inflow from the accumulation body portion through the at least one baffle member through an at least one tube member within the at least one baffle member, further slowing the water along the length of the tube within the at least one baffle member, and further passing the water into an outflow channel to gently flow out of the waterfall outlet of the waterfall apparatus. The method step of passing the water inflow from the accumulation body portion can further include the step of redirecting the water flow through an at least one deflector.

The method step of passing the water inflow from the accumulation body portion can further include the step of redirecting the water flow through an at least one deflector. The method step of redirecting the water flow can further include redirecting the water flow initially through an angled entry portion to the at least one tube member and then through an at least one deflector to reduce the velocity and smooth the water flow. The method can further comprise the method step of screening the inflow of water of debris.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

As previously noted, aesthetically pleasing waterfalls are widely used in water features to enhance landscapes. One of the challenges facing existing waterfall devices is the limitation in width and length relative to the ability to provide a clean or sheer waterfall effect. The instant invention provides exceptional flexibility in developing such an effect in any sized waterfall apparatus. Additionally, the invention provides an additional feature to prevent clogging from debris through the use of its tube members and simultaneously provides a large surface area to create resistance to, and thereby slow, the incoming water. This resistance and debris screening is further increased by various added features such as the added angled entry portion, end cap, and various other features that further enhance the performance of the instant invention. Finally, the instant invention is simple to manufacture, install and maintain. The baffle member is easily screened for debris and cleaned.

Figure 1:
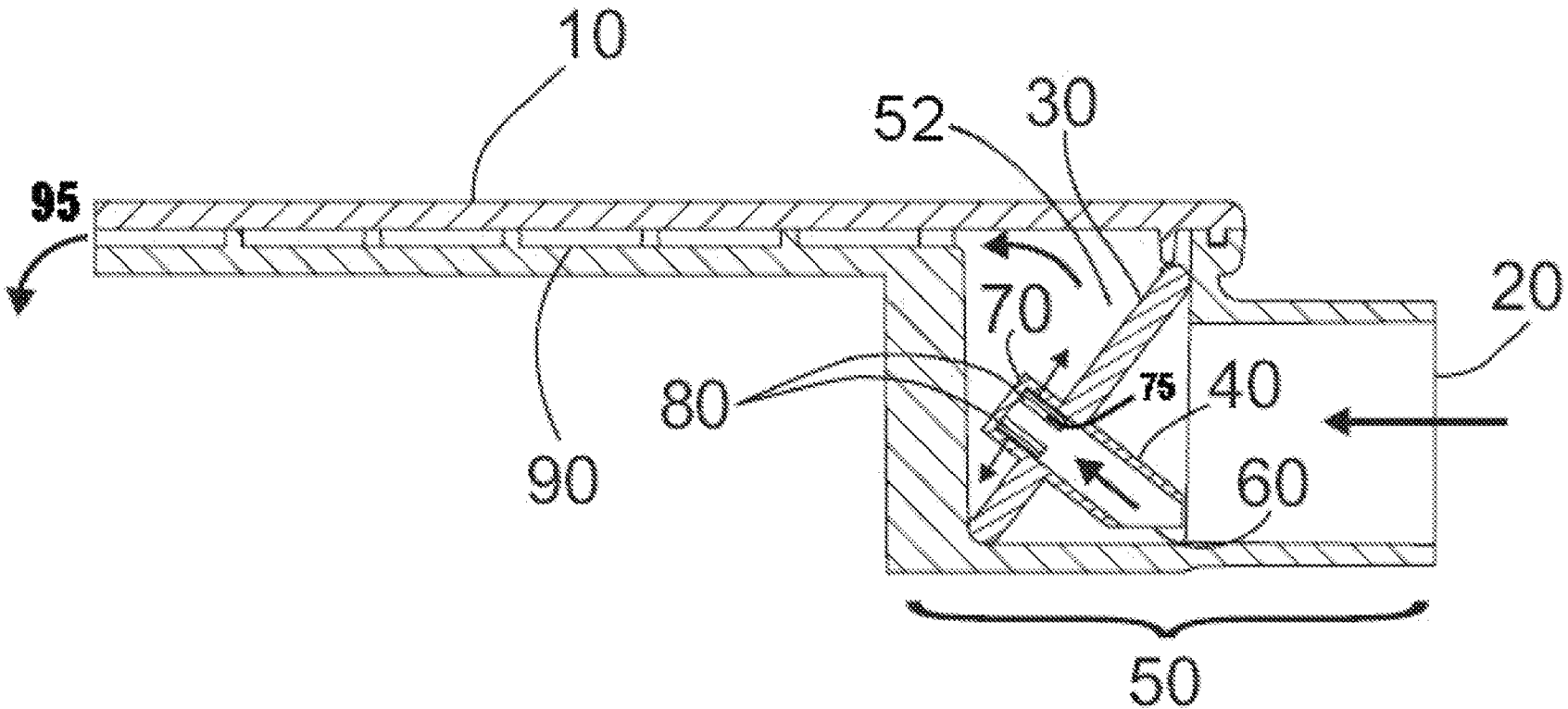
FIG. 1 is a cross-sectional view of an exemplary embodiment of the instant invention.

FIG. 1 shows a cross section of an exemplary embodiment of the instant invention. A body 10 is provided for the waterfall device, in particular a sheet-like waterfall apparatus. An at least one water inflow, here one water inflow 20, is provided. The water is permitted to flow, in accord with the direction of the arrows, into the body 10 of the waterfall device. An at least one baffle, here in the exemplary embodiment shown a single baffle 30, is used to slow and smooth the water to create an even flow. In addition, the single baffle offers manufacturing advantages, simplifying the manufacture of the exemplary embodiment and when provided with multiple, elongate tube members allows for the balancing of the flow from any individual tube members that may become blocked The at least one baffle 30 has at least one tube member 40, here a series of tube members, spaced throughout. The at least one tube member 40 may be of any length or geometry and may pass through the at least one baffle 30 at any angle. In the exemplary embodiment shown, the at least one tube member 40 passes through the at least one baffle 30 at a ninety degree angle relative to the at least one baffle member 30.

Jetting results from a tube or other that substantially increases the velocity of the water flowing there through. In most instances this is coupled with a pressure increase. The geometry of such jetting members or tubes typically has a narrowing cross section, effectively necking down the flow of the water. In comparison, the at least one tube member 40 noted herein reduces velocity and smoothes the flow of the water. The length of the at least one tube member 40 is proportional in the embodiment shown, but is certainly not limited to, being about one to three times the width of the water fall opening or outlet 95. Additional embodiments may utilize longer tube lengths, thus further assisting in smoothing and slowing the flow of water exiting the waterfall device through the waterfall opening 95. The use of the end cap or deflector 70 helps further reduce velocity and diffuse the flow. This in turn reduces the overall length of the waterfall apparatus, allowing for a more compact design in the exemplary embodiment than in pervious devices.

In an exemplary embodiment, the area of the at least one tube member 40 can be between one-hundred and one-hundred and fifty percent of the area of the outlet of the outlet channel 90 of the waterfall. In fact, the greater the outlet flow the greater the slowing affect from the at least one tube member 40. When the tube member to outlet area ratios dips substantially below about one-hundred percent the tube members begin to exhibit a tendency to jet the water. As previously stated, the at least one tube member 40 in the baffle 30 are used to create further resistance and even out the flow of water within the waterfall apparatus and avoid jetting for the most part.

The water flows into an accumulation portion 50 of the body 10 of the waterfall apparatus and contacts the baffle 30, slowing and smoothing the flow by redirecting it within the part of the accumulation portion or box 50 on the side of the baffle 30 closest to the inflow. The water is then passed through the at least one tube member 40, further slowing and smoothing the flow. In the exemplary embodiment shown, the at least one tube member 40 has an entry portion 60 that, in an exemplary embodiment, can be angled to further reduce the velocity of the water entering the at least one tube member 40 and prevent debris from flowing into the tube.

The length, distance from the bottom of the accumulation box, and angle of the angled portion can be varied to accommodate the design. In an exemplary embodiment, the distance between the angled entry portion 60 and the bottom of the accumulation portion or box 50 is varied based on the width of the at least one tube member 40 and the outflow 95 of the waterfall apparatus. In the exemplary embodiment shown, the distance between the tube and to the bottom of the chamber can be kept at about ⅛" or less to prevent debris from clogging the mouth of the waterfall and to create more resistance to even the flow. In another exemplary embodiment, the distance between the accumulation portion or box 50 is less than the smallest opening in the path of the water from the entry to the exit of the waterfall apparatus. Additionally, the angled nature of the at least one tube member 40, together with the deflector 70 help to redirect and smooth the flow of water. The angle of the angled entry portion 60 is shown in the exemplary embodiment as being cut so as to be parallel with the bottom of the accumulation portion or box 50 and further aids in redirecting, slowing, and smoothing the flow of water.

The water flow, as shown by the arrows, in the exemplary embodiment flows up the at least one tube member 40 and reaches an end cap or deflector member 70. The end cap or deflector member 70 is provided with an at least one slot or opening 80 that opens to redirect the water at about 90 to 180 degrees relative to the at least one tube member 40 and further slows and smoothes the out flowing water. The deflector member may also include a mesh material with a grid or other structure having defined outlets across the surface to diffuse the water traveling through the at least one tube member.

The water flows through the at least one tube member 40, past the deflector member 70, and into the remaining portion or outflow or outlet portion 52 of the body 10 of the waterfall apparatus. The water then passes into an outflow channel 90 and moves to gently flow out of the waterfall at outlet 95, providing a pleasingly smooth waterfall effect.

Figure 2A:
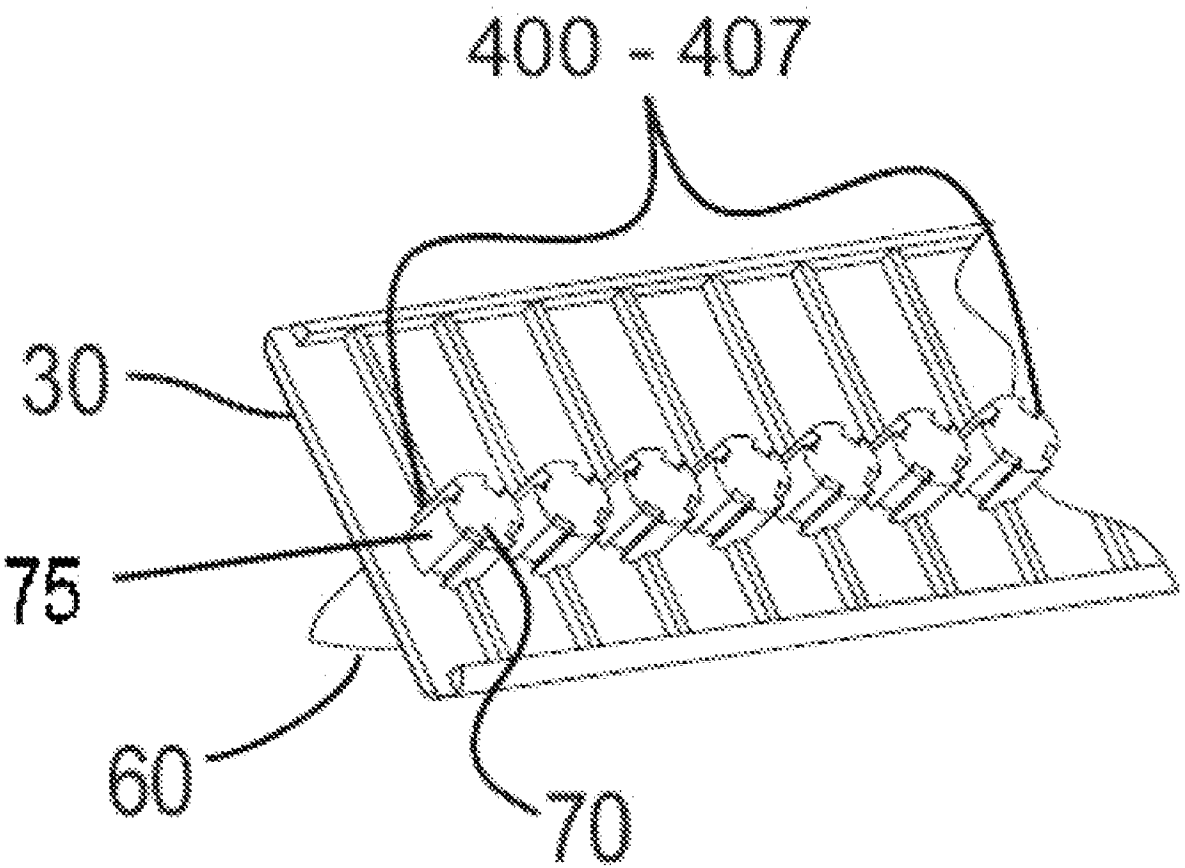
FIGS. 2A and 2B are isometric views of exemplary embodiments of the baffle of the instant invention.
Figure 2B:
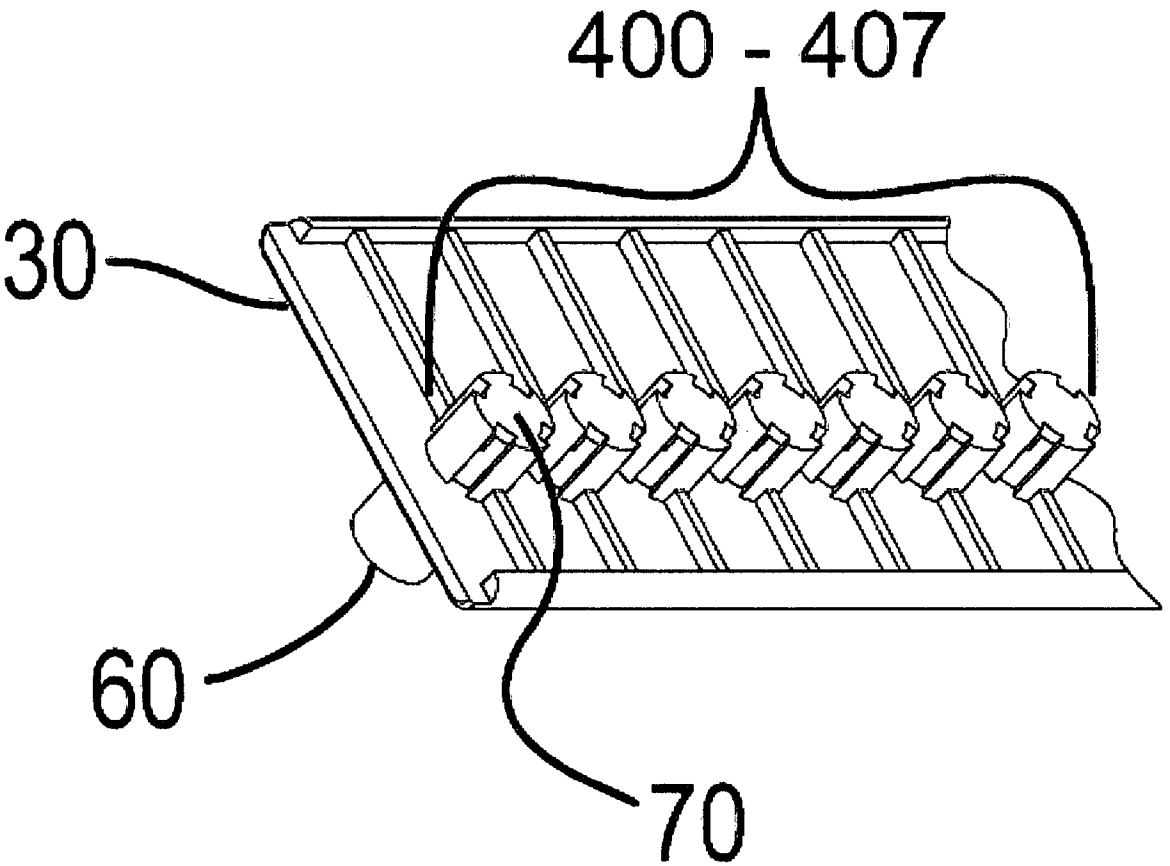

FIGS. 2A and 2B are isometric views of exemplary embodiments of the baffle of the instant invention. As shown in FIG. 2A, the exemplary embodiment of the at least one baffle 30 has multiple tube members 400-407, each having, though certainly not limited to, angled entry portions 60 and end caps or deflectors 70. The multiple tube members 400-407 are shown being equally spaced and in a single horizontal line. In FIG. 2B, the tube members 400-407 have an angled entry portion 60 that is uncut, that is a zero angle relative to the tube members 400-407. In both instances, the inflow of water into the accumulation box 50 through inflow 20 and into the at least one baffle 30 with the multiple tube members 400-407 provides for a smoothing of the water flow as the water flows to the outlet side or portion. Additionally, if debris accumulates in one of the multiple tube members 400-407, the water equalizes by flowing through the remaining tube members. Thus, in providing resistance for the inflow of water, the instant invention provides enhanced debris protection and debris accommodation in its operation.

The number of tube members, the orientation of the tube members relative to one another, and the spacing of the tube members may be varied without departing from the spirit of the invention. One non-limiting example of such a variation is a further exemplary embodiment that provides for two rows of tubes or a staggered profile of tubes, providing for an equal number of tubes in a smaller distance. Similarly, the specific geometry of the at least one tube member may be varied to suit the specific design parameters of an exemplary embodiment. For instance, some non-limiting examples of shapes for the at least one tube member 40 can include round, oval, square, elliptical and similar shapes. The function of moving the water through the at least one tube member 40 and into the end cap or deflector member 70 remains identical. The at least one tube member 40 may also operate without an end cap or deflector member 70, as stated above.

Figure 3:
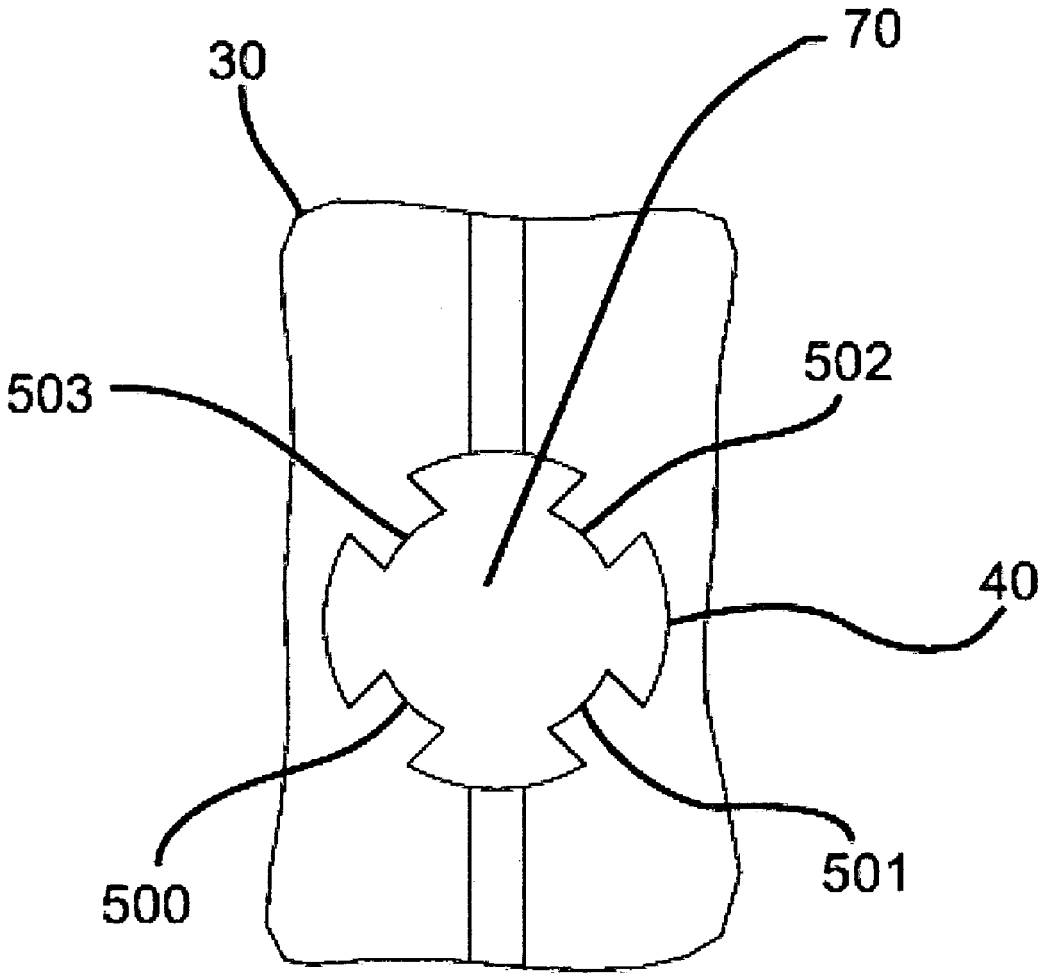
FIG. 3 is a front view of an exemplary embodiment of an end cap for the tube of the at least one invention.

FIG. 3 is a front view of an exemplary embodiment of an end cap for the tube of the at least one invention. In the exemplary embodiment shown, the end cap or deflector member 70 is shown having four equally spaced outlets 500-503 for deflecting and slowing the out flowing water and dispersing the flow to further slow and smooth the water. Although in the exemplary embodiment shown there are four equally spaced outlets 500-503, greater or fewer outlets can be provided and the width and length of the outlets varied without departing from the spirit of the invention. The outlet can be angled between about 90 degrees and 180 degrees relative to the direction of flow of the water within the at least one tube member 40, as shown by the arrows, or the at least one tube member 40 itself. This redirection and subsequent dispersal of the flow of water helps to smooth the flow of water in the waterfall apparatus. Additionally, the deflector or end cap 70 may be fitted with extensions or outlet extensions 75 further aiding in controlling and redirecting the flow from the at least one tube member 40.

Figure 4:
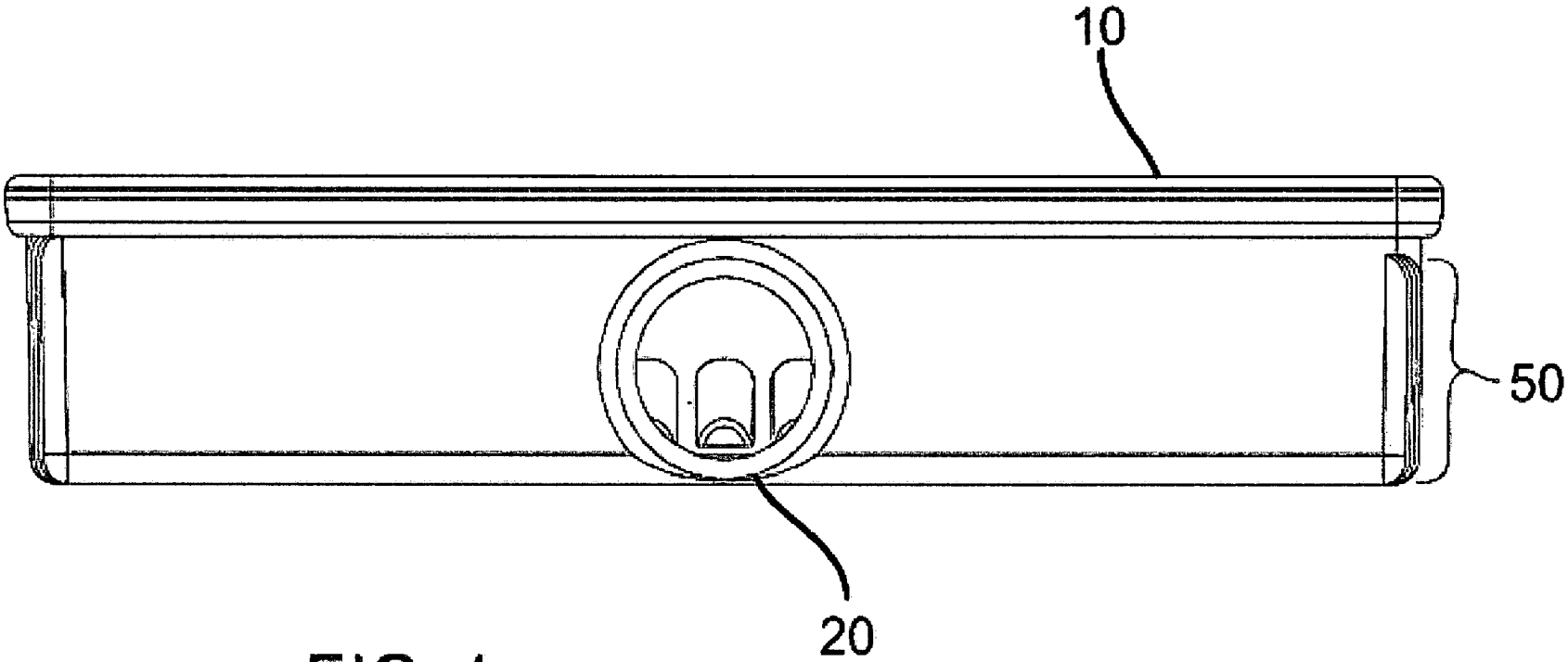
FIG. 4 is a rear view of an exemplary embodiment of the instant invention.

FIG. 4 is a rear view of an exemplary embodiment of the instant invention. The exemplary embodiment of the invention shown has a single water inflow 20. This flows into the water accumulation portion 50 as described above. As noted, the water flows into the accumulation portion 50 and into the at least one baffle member 30. The water passes through the angled entry portion 60 and into the at least one tube member 40. If there is debris it will be screened at the angled entry portion 60. The water will be passed through the at least one tube member 40, through the deflector member 70, into the outflow channel 90 and out through the waterfall outlet 95.

Figure 5:
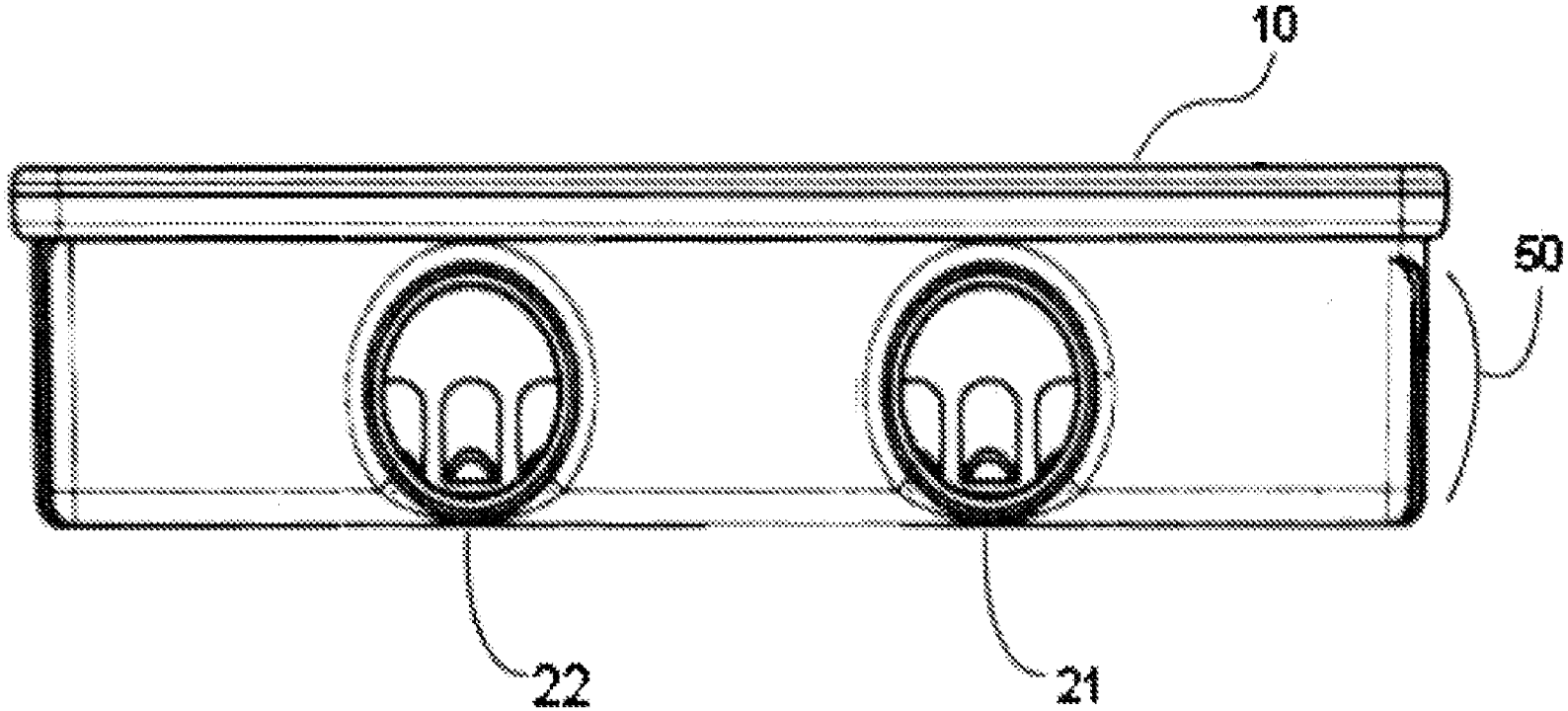
FIG. 5 is a rear view of yet another exemplary embodiment of the instant invention.

FIG. 5 is a rear view of yet another exemplary embodiment of the instant invention. The exemplary embodiment shown has multiple water inflow paths 21 and 22. This provides for an increased volume and size in the embodiment. The scalability of the instant invention via increased numbers of inflow paths is, therefore, easily understood by one of ordinary skill in the art as the smoothing of the inflow of water is unlimited and the at least one baffle 30, sufficiently supported by the body 10, can be scaled to fit heretofore unachievable sizes of waterfall apparatuses while providing smooth operation and a pleasing visual effect.

The embodiments and examples discussed herein are non-limiting examples. The invention is described in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. A waterfall apparatus comprising:

an at least one water supply inflow supplying water to the waterfall apparatus;

a body member having the water flowing therethrough;

a water accumulation portion of the body member coupled to and being filled by the at least one water supply inflow;

an at least one baffle having an at least one tube member interspaced thereon and extending from the accumulation portion of the body member to an outlet portion of the body member;

an at least one deflector member with an at least one outlet slot, the at least one outlet slot slowing and directing the water from the at least one tube member in a smoothed, low pressure state into the outlet portion of the body member; and an outlet flow path in communication with the outlet portion of the body member, passing the water from the outlet portion of the body member along the outlet flow path and through a waterfall outlet and forming a sheet like waterfall outflow.

2. The waterfall apparatus of claim 1, wherein the at least one deflector member with an at least one outlet slot further includes an at least one outlet extension that redirects water out of the at least one tube member at about a 90 degree angle relative to the end of the at least one tube member.

3. The waterfall apparatus of claim 1, wherein the at least one outlet slot comprises four slots spread equidistantly around the at least one tube member.

4. The waterfall apparatus of claim 1, wherein the at least one tube member extends from the at least one baffle member at a 90 degree angle relative to the at least on baffle member.

5. The waterfall apparatus of claim 1, further comprising an entry portion of the at least one tube member and a bottom portion of the water accumulation portion of the body member.

6. The waterfall apparatus of claim 5, wherein the entry portion of the at least one tube member is angled relative to the at least one baffle member to form an angled entry portion and further reduce the velocity of the water within the at least one tube member.

7. The waterfall apparatus of claim 6, wherein the distance between the bottom portion of the water accumulation portion and the angled entry portion is a ratio of the width of the at least one tube member and the waterfall outlet.

8. The waterfall apparatus of claim 6, wherein the distance between the bottom portion of the water accumulation portion and the angled entry portion is a function of the width of the at least one tube member and the volume of outflow of the waterfall apparatus.

9. The waterfall apparatus of claim 6, wherein the distance between the bottom portion of the water accumulation portion of the body member and the angled entry portion is equal to or less than ⅛ inch.

10. The waterfall apparatus of claim 1, the at least one tube member is at least one of a round, oval, square, and elliptical shape.

11. The waterfall apparatus of claim 5, wherein the entry portion of the at least one tube member is angled relative to a wall of the at least one tube member to further reduce the velocity of the water through redirection into the at least one tube member and the at least one tube member is elongate and penetrates the baffle member at ninety-degrees to the baffle member and an at least one diffusing member is provided at a point on the at least one tube member and the combination of the angled entry portion, the elongate at least one tube member, and the diffusing member reduce the velocity of the water flowing through the device to provide a smoothed, sheet-like waterfall at the waterfall outlet.

12. A method of slowing a flow of water within a waterfall apparatus, comprising the steps of:

providing a water inflow into an accumulation body portion of the waterfall apparatus;

slowing the inflow by directing it into an at least one baffle member;

passing the water inflow from the accumulation body portion through the at least one baffle member through an at least one tube member within the at least one baffle member and redirecting the water flow through an at least one deflector;

further slowing the water along the length of the tube within the at least one baffle member; and further passing the water into an outflow channel to gently flow out of a waterfall outlet of the waterfall apparatus.

13. The method of claim 12, wherein the method step of redirecting the water flow further comprises redirecting the water flow initially through an angled entry portion to the at least one tube member and then through the at least one deflector to reduce the velocity and smooth the water flow.

14. The method of claim 12, further comprising the method step of screening the inflow of water of debris.

15. The waterfall apparatus of claim 1, wherein the at least one deflector member is located on an end of the at least one tube member closest to the outlet portion of the body member.

* * * * *